US009254665B2

(12) United States Patent
Shinoto et al.

(10) Patent No.: US 9,254,665 B2
(45) Date of Patent: Feb. 9, 2016

(54) LIQUID EJECTING APPARATUS

(71) Applicant: SEIKO EPSON CORPORATION, Tokyo (JP)

(72) Inventors: Akira Shinoto, Shimosuwa-machi (JP); Keiichiro Yoshino, Matsumoto (JP); Masaki Uchiyama, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/551,987

(22) Filed: Nov. 24, 2014

(65) Prior Publication Data

US 2015/0158302 A1 Jun. 11, 2015

(30) Foreign Application Priority Data

Dec. 9, 2013 (JP) ..... 2013-253927

(51) Int. Cl.
*B41J 2/165* (2006.01)

(52) U.S. Cl.
CPC ..... *B41J 2/16544* (2013.01); *B41J 2/16538* (2013.01)

(58) Field of Classification Search
CPC ..... B41J 2/165; B41J 2/16505; B41J 2/1707; B41J 2/117174; B41J 2/16538; B41J 2/16535; B41J 2/16544; B41J 2/1647; B41J 2002/1655
See application file for complete search history.

(56) References Cited

U.S. PATENT DOCUMENTS 6,196,659 B1 * 3/2001 Nitta ..... 347/33
2013/0120495 A1 5/2013 Nakamura et al.

FOREIGN PATENT DOCUMENTS

| | | |
|---|---|---|
| JP | 2005-262561 | 9/2005 |
| JP | 2012-126090 | 7/2012 |
| JP | 2012-218238 | 11/2012 |
| JP | 2013-103376 | 5/2013 |

* cited by examiner

*Primary Examiner* — Geoffrey Mruk
(74) *Attorney, Agent, or Firm* — Workman Nydegger

(57) ABSTRACT

A liquid ejecting apparatus includes a liquid ejecting portion provided with a nozzle opening area in which a plurality of nozzles ejecting liquid onto a medium are open; and a wiping portion that wipes the nozzle opening area in a first direction and a second direction opposite to the first direction, in which the nozzle opening area includes a first wiping target area and a second wiping target area which are at different positions in a direction intersecting with the first direction, and the wiping portion wipes the first wiping target area in the first direction, and wipes the second wiping target area in the second direction.

12 Claims, 6 Drawing Sheets

LIQUID EJECTING APPARATUS

BACKGROUND

1. Technical Field

The present invention relates to a liquid ejecting apparatus such as a printer.

2. Related Art

In the related art, there is an ink jet printer that includes a recording head that ejects ink onto a sheet or the like, and a wiping member that moves relative to the recording head, and performs a wiping operation of wiping ink or the like adhered to the recording head according to a relative movement of a wiping member as an example of a liquid ejecting apparatus (for example, see JP-A-2013-103376).

However, if a target area to be wiped is wide, or a plurality of target areas are at separate positions, the recording head wipes an area while moving in one direction, returns to the original position, and wipes another area while moving in the one direction again. Therefore, the wiping member has to move in a reciprocating manner a plurality of times until the wiping operation is finished, and it takes time to perform the wiping operation.

SUMMARY

An advantage of some aspects of the invention is to provide a liquid ejecting apparatus that can quickly perform the wiping operation.

Hereinafter, means of the invention and operation effects thereof will be described.

According to an aspect of the invention, there is provided a liquid ejecting apparatus including a liquid ejecting portion provided with a nozzle opening area in which a plurality of nozzles ejecting liquid onto a medium are open; and a wiping portion that wipes the nozzle opening area in a first direction and a second direction opposite to the first direction, in which the nozzle opening area includes a first wiping target area and a second wiping target area which are at different positions in a direction intersecting with the first direction, and the wiping portion wipes the first wiping target area in the first direction, and wipes the second wiping target area in the second direction.

According to the configuration, after the first wiping target area is wiped in the first direction in the outbound movement, the wiping portion can wipe the second wiping target area in the second direction in an inbound movement. Therefore, the wiping portion can perform the wiping operation more quickly than in the case in which the wiping portion returns to the original position after the first wiping target area is wiped in the first direction to wipe the second wiping target area in the first direction again.

In the liquid ejecting apparatus, a length of the wiping portion may be shorter than that of the nozzle opening area in a direction intersecting with the first direction.

According to the configuration, the size of the apparatus can be reduced by causing the length of the wiping portion in the direction intersecting with the first direction to be shorter than that of the nozzle opening area.

In the liquid ejecting apparatus, the liquid ejecting portion can move between a transportation area in which the medium is transported and a waiting position at which the liquid ejecting portion waits in a direction intersecting the first direction, and the wiping portion may be disposed between the transportation area and the waiting position in a direction intersecting the first direction, and may wipe the first wiping target area and the second wiping target area in an order from an area on the transportation area side in a direction intersecting the first direction.

According to the configuration, after the wiping portion wipes the wiping area on the transportation area side in the direction intersecting with the first direction between the first wiping target area and the second wiping target area, the wiping portion wipes the wiping area on the waiting position side of the liquid ejection portion moved to the transportation area side. Accordingly, a position of the liquid ejecting portion when the wiping of the two wiping areas is finished is at a position closer to the transportation area than in the case in which the wiping area on the transportation area side is wiped later. Therefore, after the wiping of the wiping area is finished, the liquid ejecting portion can quickly move to the transportation area.

In the liquid ejecting apparatus, the wiping portion may be formed of a portion of a wiping member, and may include a holding mechanism that holds the wiping member, and the holding mechanism may change a position of the wiping portion in the wiping member so that different positions of the wiping member when the wiping portion wipes the first wiping target area and when the wiping portion wipes the second wiping target area come into contact with the liquid ejecting portion.

According to the configuration, since different positions of the wiping member come into contact with the liquid ejecting portion when the first wiping target area is wiped and the second wiping target area is wiped, the wiping performance when the two different wiping areas are wiped can be set to be at the same level.

In the liquid ejecting apparatus, an end edge of the first wiping target area when the first wiping target area is wiped in the first direction may be on an ending point side from the second wiping target area in the first direction.

According to the configuration, since the end edge of the first wiping target area when the first wiping target area is wiped in the first direction is on the ending point side of the second wiping target area in the first direction, even if liquid scatters in the first direction by the force generated when the wiping portion in which the first wiping target area is wiped is separated from the liquid ejecting portion, the scattered liquid is hardly adhered to the second wiping target area.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid ejecting apparatus are described with reference to drawings.

For example, the liquid ejecting apparatus is an ink jet-type printer that performs the printing operation by ejecting ink, which is a kind of liquid, onto a medium such as a sheet.

Figure 1:
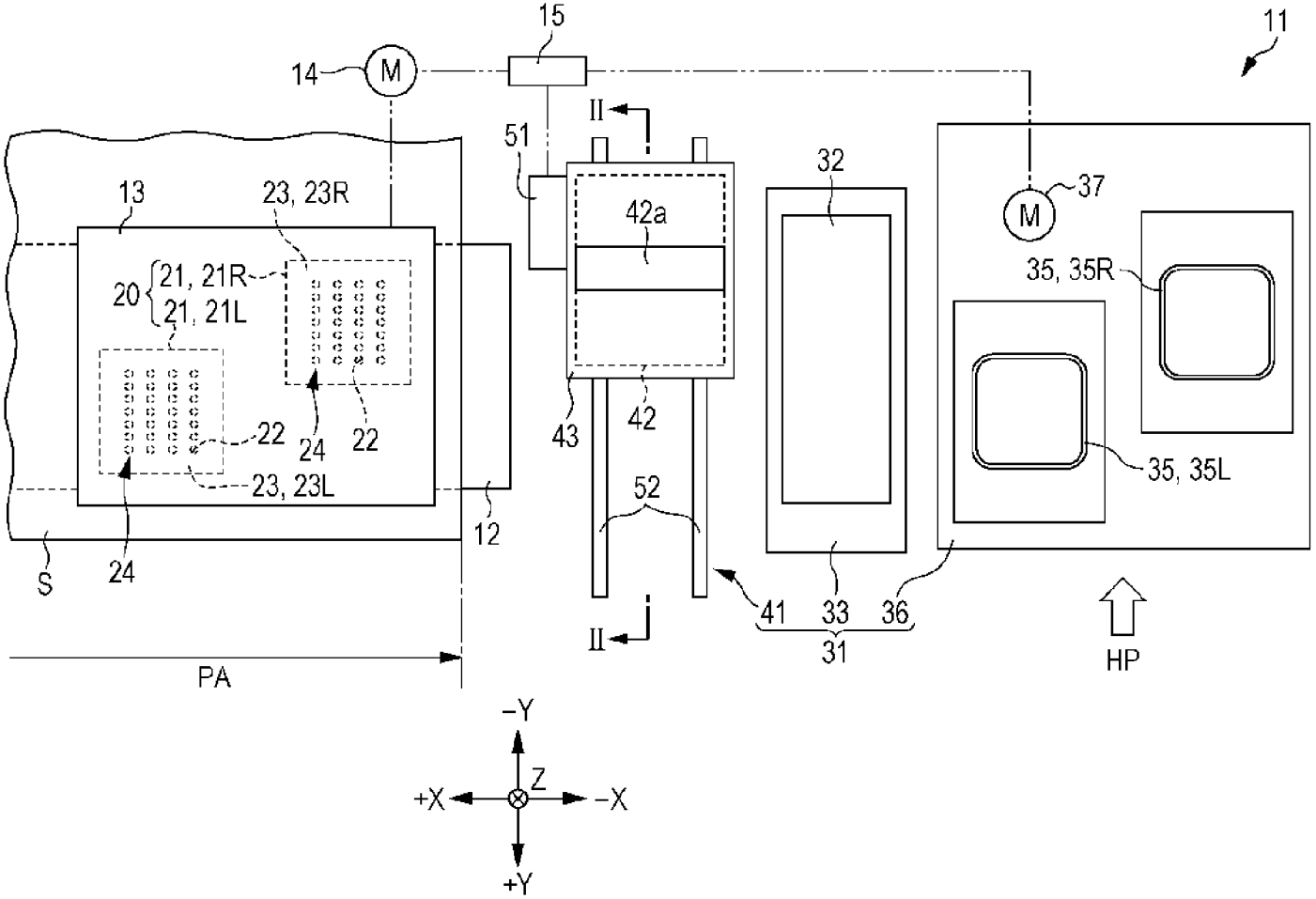
FIG. 1 is a plan view schematically illustrating a configuration of a liquid ejecting apparatus according to an embodiment.

As illustrated in FIG. 1, a liquid ejecting apparatus 11 includes a supporting stand 12 that supports a medium S, a liquid ejecting portion 20 that ejects liquid onto the medium S supported by the supporting stand 12, a carriage 13 that holds the liquid ejecting portion 20, a maintenance mechanism 31 for performing maintenance of the liquid ejecting portion 20, and a control portion 15 that controls the liquid ejecting apparatus 11.

The liquid ejecting portion 20 includes two ejecting heads 21 (21L and 21R) that are held by the carriage 13. The ejecting heads 21 are attached to the lower portion of the carriage 13 so that a nozzle opening area 23 in which a plurality of nozzles 22 ejecting droplets are open faces the supporting stand 12 with a predetermined gap in a vertical direction Z. In the embodiment, the nozzle opening area 23 in which the plurality of nozzles 22 are open in the first ejecting head 21L are referred to as a first wiping target area 23L, and the nozzle opening area 23 in which the plurality of nozzles 22 are open in the second ejecting head 21R is referred to as a second wiping target area 23R.

The wiping areas 23L and 23R refer to nozzle forming surfaces formed with lower surfaces of the ejecting heads 21L and 21R, but the wiping areas 23L and 23R may be formed with only areas near nozzle openings for which influencing the ejection of droplets when foreign matter is attached to the nozzle forming surface is a concern, not necessarily the entire lower surfaces of the ejecting heads 21. In addition, examples of foreign matter which is possibly attached to the ejecting heads 21 include paper powder generated from a sheet as the medium S, fiber fragments generated from cloth as the medium S, mist generated by the ejection of droplets, and dust.

The supporting stand 12 may include a heating body functioning as a drying mechanism that accelerates drying of the medium S that receives liquid. In addition, a heating body that heats the medium S from an upper portion of the liquid ejecting portion 20, a blowing apparatus that blows wind toward the medium S, or the like may be provided as a drying mechanism for accelerating drying of the medium S.

When the carriage motor 14 is driven by the control of the control portion 15, the carriage 13 performs reciprocating scanning in a scanning direction X (+X and −X) which is a direction in which the supporting stand 12 and the maintenance mechanism 31 are arranged in parallel. When the liquid ejecting portion 20 performs the printing operation by ejecting ink from the nozzles 22 of the ejecting heads 21 to the medium S on the supporting stand 12 while the carriage 13 performs scanning in the scanning direction X. In the embodiment, an area which ejects liquid onto the medium S on which the liquid ejecting portion 20 performs the printing operation, and to which the medium S can be transported is referred to as a transportation area PA.

A plurality of rows are formed so that nozzle rows 24 in which the plurality of nozzles 22 which are parallel to the direction Y (+Y and −Y) that intersects (crosses at right angle according to the embodiment) with both directions of the scanning direction X and the vertical direction Z are formed on the ejecting heads 21L and 21R so as to be arranged in parallel in the scanning direction X. The plurality of nozzles 22 that configure one nozzle row 24 eject the same kind of liquid (for example, the same color ink), and the plurality of nozzle rows 24 eject different kinds of liquid (for example, ink of different colors such as cyan, magenta, yellow, and black).

The medium S on which the printing operation is performed is disposed on the supporting stand 12 and retracted from the supporting stand 12 by being transported in a direction +Y by a transporting mechanism (not illustrated). Then, according to the embodiment, the direction +Y which is the transportation direction of the medium S is referred to as the first direction +Y, and the direction −Y which is opposite to the first direction +Y is referred to as the second direction −Y.

The ejecting heads 21L and 21R are disposed at positions to be separated from each other in the scanning direction X. Therefore, the first wiping target area 23L and the second wiping target area 23R are at different positions in the scanning direction X. Further, the ejecting heads 21L and 21R are disposed at positions to be separated from each other at a certain distance in the direction Y (+Y and −Y). For example, a downstream end of the first wiping target area 23L in the transportation direction (the first direction +Y) is disposed downstream from the second wiping target area 23R, and an upstream end of the second wiping target area 23R in the transportation direction (the first direction +Y) is disposed upstream from the first wiping target area 23L.

The maintenance mechanism 31 is disposed inside a scanning area of the carriage 13 in the scanning direction X and on an outer side of the transportation area PA (right side of FIG. 1). The maintenance mechanism 31 includes a wiping unit 41, a flushing unit 33 having a liquid receiving portion 32, and the cap unit 36 having two cap portions 35 (35L and 35R) disposed in parallel in sequence from a position near the transportation area PA in the scanning direction X.

The carriage 13 and the liquid ejecting portion 20 wait at a waiting position HP at which a cap unit 36 is disposed when the printing operation is not performed or the power supply is in an off state. That is, the liquid ejecting portion 20 can move between the transportation area PA to which the medium S is transported and the waiting position HP at which the liquid ejecting portion 20 waits in the scanning direction X that intersects with the first direction +Y.

In the scanning direction X, the direction from the waiting position HP to the transportation area PA is referred to as the first scanning direction +X, and the direction from the transportation area PA to the waiting position HP is referred to as the second scanning direction −X. Then, the carriage 13 at the waiting position HP moves in the first scanning direction +X in an outbound way, and then moves in the second scanning direction −X in an inbound way to return to the waiting position HP.

When the liquid ejecting portion 20 is disposed at the waiting position HP, the cap portions 35L are positioned on the lower side of the first ejecting head 21L, and the cap portions 35R are positioned on the lower side of the second ejecting head 21R. The cap portions 35L and 35R move between a position for coming into contact with the wiping areas 23L and 23R and a position for being separated from the wiping areas 23L and 23R by driving a capping motor 37 under the control of the control portion 15.

The cap portions 35L and 35R form a closed space between the wiping areas 23L and 23R by coming into contact with the ejecting heads 21L and 21R, respectively, so as to enclose the plurality of nozzles 22 and control the drying of the nozzles 22. Enclosing the area in which the nozzles 22 are open by the cap portions 35 is referred to as capping. The ejecting heads 21L and 21R are capped by the cap portions 35L and 35R at the waiting position HP when the printing operation is not performed or the like.

Further, when the liquid ejecting portion 20 is disposed on the upper portion of the flushing unit 33, the ejecting heads 21 perform flushing of ejecting liquid to the liquid receiving portion 32. Flushing refers to ejecting droplets irrelevant to the printing operation from the nozzles 22 for the purpose of preventing or eliminating the clogging of the nozzles 22, or the like. In addition, when the ejecting head 21L is disposed in the upper portion of the wiping unit 41, the flushing unit 33 is disposed so that the liquid receiving portion 32 is positioned in the lower portion of the ejecting head 21R.

The wiping unit 41 includes a wiping member 42 that can absorb liquid, a holding mechanism 43 that holds the wiping member 42, and a wiping motor 51. The wiping member 42 can realize the configuration of absorbing liquid in a gap between fibers of a synthetic resin by being formed of a nonwoven fabric such as a synthetic resin. The wiping member 42 is detachably attached to the holding mechanism 43. Therefore, the wiping member 42 can be replaced with a new one after use or the like.

The holding mechanism 43 is supported by a pair of guide shafts 52 extending in the direction Y, and moves along the guide shafts 52 in the first direction +Y or the second direction −Y by the driving force of the wiping motor 51 when the wiping motor 51 is driven under the control of the control portion 15. That is, the direction Y (+Y and −Y) is the moving direction Y of the holding mechanism 43. Further, the holding mechanism 43 is disposed at the starting position (position illustrated in FIG. 1) on the upstream side of the medium S in the transportation direction (the first direction +Y) when the wiping operation is not performed, the power supply is in an off state, or the like.

Figure 2:
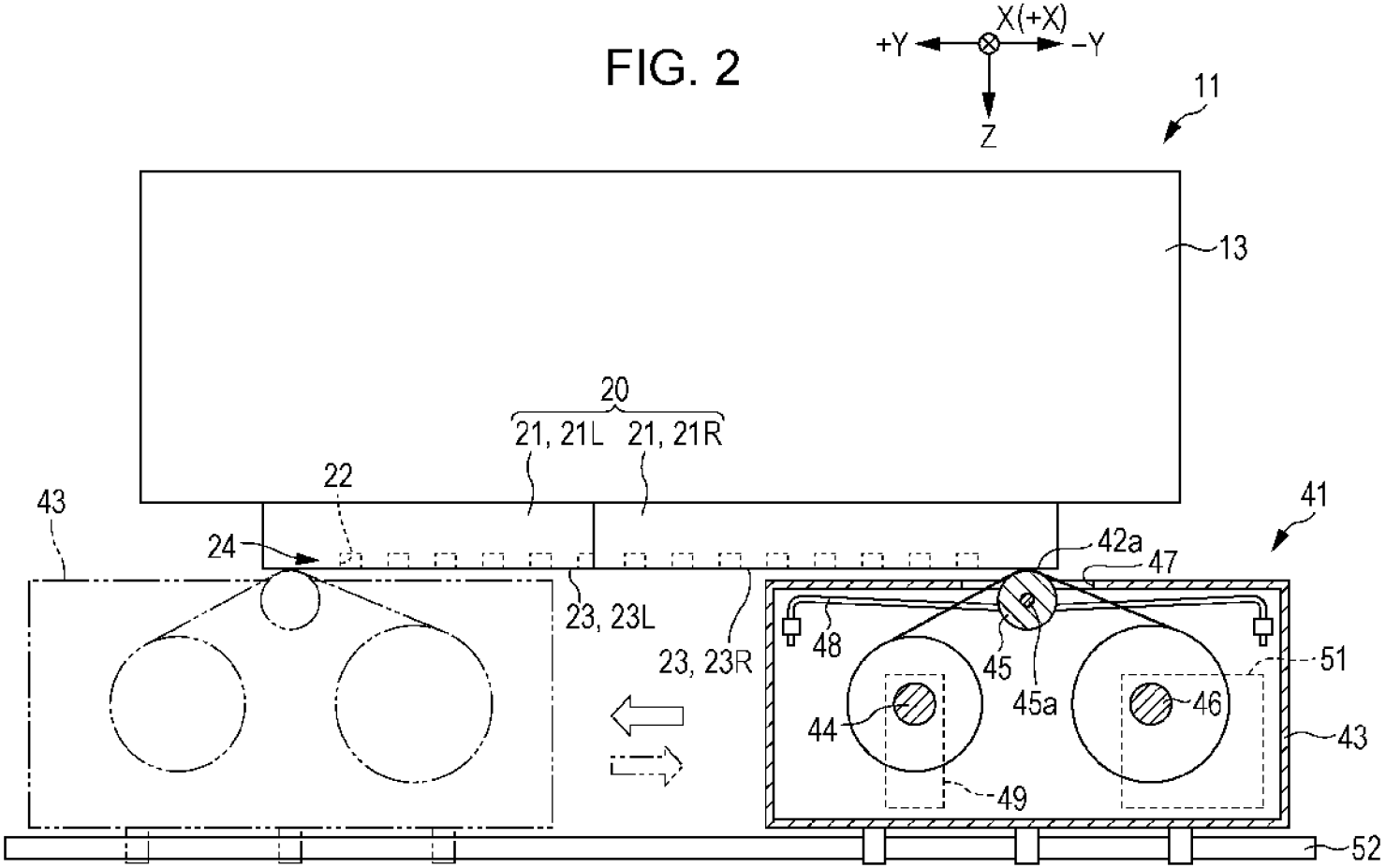
FIG. 2 is a cross-sectional view taken along the line II-II of FIG. 1.

For example, if the wiping motor 51 is rotationally driven in the first rotating direction, the holding mechanism 43 moves in the first direction +Y in an outbound way from the starting position to the ending position (position indicated by alternating long and two short dashed lines in FIG. 2), and moves in the second direction −Y in an inbound way from the ending position to the starting position if the wiping motor 51 is rotationally driven in the second rotating direction which is opposite to the first rotating direction.

As illustrated in FIG. 2, a feeding axis 44, in which the scanning direction X is the axis direction, a pressing roller 45, and a winding axis 46 are stored in parallel in the moving direction Y in the holding mechanism 43. The wiping member 42 is formed to be a belt shape, and the base end side in the longitudinal direction is wound onto the feeding axis 44, and the front end side in the longitudinal direction is wound onto the winding axis 46. Further, in the wiping member 42, a portion between the feeding axis 44 and the winding axis 46 is wound onto the pressing roller 45. The portion of the wiping member 42 wound onto the pressing roller 45 becomes a wiping portion 42*a* disposed at the wiping position that can wipe the nozzle opening area 23 by protruding to the upper portion in the vertical direction Z through an opening portion 47 provided in the holding mechanism 43.

A rotation axis 45*a* of the pressing roller 45 is urged to the upper portion in the vertical direction Z by an urging member 48. For example, the urging member 48 is a pair of bar springs attached to two side walls of the holding mechanism 43 that face each other. Therefore, the contact pressure onto the ejecting heads 21 of the wiping portion 42*a* is set based on the urging force of the urging member 48.

In the scanning direction X (direction orthogonal to the paper surface in FIG. 2) intersecting with the first direction +Y, the length of the wiping portion 42*a* is shorter than the length of the entire nozzle opening area 23 including the first wiping target area 23L and the second wiping target area 23R. Further, in the scanning direction X, the first wiping target area 23L and the second wiping target area 23R are the same in length, and the wiping portion 42*a* has the same length as the wiping areas 23L and 23R. Accordingly, the wiping portion 42*a* can wipe the entire first wiping target area 23L or the entire second wiping target area 23R by moving in the first direction +Y or the second direction −Y, but may not wipe the entire nozzle opening area 23 including the first wiping target area 23L and the second wiping target area 23R by moving in one direction.

The length of the wiping portion 42*a* in the scanning direction X is set based on the length of the pressing roller 45 in the scanning direction X. Therefore, if the lengths of the wiping member 42 and the pressing roller 45 in the scanning direction X are set to be the same, the lengths of the wiping member 42 and the wiping portion 42*a* become the same. If the pressing roller 45 is shorter than the wiping member 42 in the scanning direction X, the wiping portion 42*a* is shorter than the wiping member 42 in the scanning direction X. However, the pressing roller 45 and the wiping member 42 preferably have the same lengths as the wiping areas 23L and 23R in order to reduce the size of the wiping unit 41.

The winding axis 46 is connected to the wiping motor 51 by a clutch mechanism (not illustrated) or the like. Then, for example, if the wiping motor 51 is rotationally driven in the first rotating direction, the winding axis 46 rotates in a clockwise direction in FIG. 2, and if the wiping motor 51 is rotationally driven in the second rotating direction, the winding axis 46 rotates in a counterclockwise direction in FIG. 2. If the winding axis 46 rotates in a clockwise direction in FIG. 2, the wiping member 42 positioned between the feeding axis 44 and the winding axis 46 is wound onto the winding axis 46. Therefore, the rotating direction when the winding axis 46 rotates in the clockwise direction in FIG. 2 is referred to as a winding direction.

The feeding axis 44 is connected to a regulating mechanism 49 that can regulate the rotation of the feeding axis 44. If the feeding axis 44 rotates in the clockwise direction in FIG. 2, the wiping member 42 wound onto the feeding axis 44 is fed out. Therefore, the rotating direction when the feeding axis 44 rotates in a clockwise direction in FIG. 2 is referred to as the feeding direction.

When the rotation of the feeding axis 44 is not regulated by the regulating mechanism 49, if the winding axis 46 rotates in the winding direction, the wiping member 42 positioned between the feeding axis 44 and the winding axis 46 is wound onto the winding axis 46, and accordingly, the feeding axis 44 rotates in the feeding direction, so that the wiping member 42 is fed out. Accordingly, the position of the wiping portion 42*a* in the wiping member 42 changes.

Meanwhile, when the rotation of the feeding axis 44 is regulated by driving the regulating mechanism 49, if the winding axis 46 rotates in the winding direction, the wiping member 42 positioned between the feeding axis 44 and the winding axis 46 is wound onto the winding axis 46 without feeding out the wiping member 42 from the feeding axis 44. Accordingly, since the length of the wiping member 42 positioned between the feeding axis 44 and the winding axis 46 is shortened, the shortened wiping member 42 presses the pressing roller 45, and the pressed pressing roller 45 moves to the lower portion in the vertical direction Z against the urging force of the urging member 48. In this case, the wiping portion 42*a* is disposed at a retracted position separated from the ejecting heads 21 in the vertical direction Z.

In this manner, when the wiping portion 42*a* is at the retracted position, if the regulating mechanism 49 stops driving, the feeding axis 44 in which the regulation of the rotation is removed rotates in the feeding direction, the wiping member 42 is fed out, and the pressing roller 45 is urged by the urging force of the urging member 48 and moves to the upper portion in the vertical direction Z. Accordingly, the wiping portion 42*a* returns from the retracted position to the wiping position, and the position of the wiping portion 42*a* in the wiping member 42 is changed.

In contrast, when the wiping portion 42*a* is at the retracted position, if the winding axis 46 rotates in a reverse direction of the winding direction, the length of the wiping member 42 positioned between the feeding axis 44 and the winding axis 46 is lengthened. Therefore, the pressing roller 45 moves to the upper portion of the vertical direction Z by the urging force of the urging member 48. Accordingly, the wiping portion 42*a* returns from the retracted position to the wiping position, but the position of the wiping portion 42*a* in the wiping member 42 does not change, at this point.

When the holding mechanism 43 is disposed at the starting position (position indicated by a solid line in FIG. 2), the wiping portion 42*a* is preferably at a position at which the wiping portion 42*a* is overlapped with the ejecting head 21R in the moving direction Y. According to the configuration, the movement distance of the holding mechanism 43 according to the wiping operation is shorter than in the case in which the wiping portion 42*a* and the ejecting heads 21 are not overlapped with each other at the starting position. Therefore, the performance time of the wiping operation can be shortened, and the size of the wiping unit 41 in the moving direction Y can be reduced.

Subsequently, the wiping operation in the liquid ejecting apparatus 11 is described.

As the liquid ejecting apparatus 11, the wiping operation of wiping the wiping areas 23L and 23R by the wiping portion 42*a* is performed before or after the printing operation or the like at a certain timing.

For example, if the wiping operation is performed after the printing operation on the medium S, the control portion 15 controls a carriage motor 14 to move the liquid ejecting portion 20 together with the carriage 13 from the transportation area PA to the second scanning direction −X, and the first wiping target area 23L in the scanning direction X stops at a position (position illustrated in FIGS. 3A and 3B; hereinafter, this is called "first stop position") in which the first wiping target area 23L is overlapped with the wiping portion 42*a*. In this manner, before the wiping operation, a step in which the liquid ejecting portion 20 moves to the first stop position is referred to as a first movement step.

The control portion 15 preferably drives the regulating mechanism 49 and the wiping motor 51 to move the wiping portion 42*a* to the retracted position in the first movement step. This is because unnecessary contact between the moving ejecting heads 21 and the moving wiping portion 42*a* is suppressed in this manner and the abrasion of the nozzle opening area 23 can be suppressed. In this case, after the liquid ejecting portion 20 stops at the first stop position, the control portion 15 rotates the winding axis 46 in the reverse direction of the winding direction, and returns the wiping portion 42*a* from the retracted position to the wiping position.

Subsequently, in the first wiping step, the control portion 15 drives the wiping motor 51 to move the holding mechanism 43 from the starting position to the ending position in the first direction +Y in the outbound way. In this case, the wiping portion 42*a* wipes the first wiping target area 23L in the first direction +Y. That is, the wiping direction of the liquid ejecting portion 20 in the first wiping step becomes the first direction +Y (direction indicated by arrows outlined with solid lines in FIGS. 2 and 3A) from the starting position to the ending position.

If the first wiping step ends, as the second movement step, the control portion 15 controls the carriage motor 14, and moves the liquid ejecting portion 20 together with the carriage 13 in the first scanning direction +X so that the second wiping target area 23R stops at a position (position indicated in FIGS. 4A and 4B; hereinafter, this is referred to as a "second stop position") at which the second wiping target area 23R is overlapped with the wiping portion 42*a* in the scanning direction X.

In the second movement step, the control portion 15 preferably drives the regulating mechanism 49 and the wiping motor 51 to retract the wiping portion 42*a* to the retracted position. Accordingly, unnecessary contact between the moving liquid ejecting portion 20 and the moving wiping portion 42*a* is suppressed.

In this case, after the liquid ejecting portion 20 stops at the second stop position, the control portion 15 stops the driving of the regulating mechanism 49 to return the wiping portion 42*a* from the retracted position to the wiping position and to change the position of the wiping portion 42*a* in the wiping member 42. Accordingly, in the wiping member 42, a portion to which liquid is adhered by the wiping of the first wiping target area 23L is moved to the winding axis 46 side so that a portion to which liquid is not adhered becomes the new wiping portion 42*a*.

In this manner, a step of changing a position of the wiping portion 42*a* in the wiping member 42 after the first wiping step is referred to as a first winding step. Then, in the embodiment, the second movement step and the first winding step proceed in parallel.

After the second movement step and the first winding step, as the second wiping step, the control portion 15 drives the wiping motor 51 to move the holding mechanism 43 from the ending position to the starting position in the second direction −Y in an inbound way. In this case, the wiping portion 42*a* wipes the second wiping target area 23R in the second direction −Y. That is, the wiping direction of the liquid ejecting portion 20 in the second wiping step becomes the second direction −Y (the direction indicated by the arrow outlined with the alternating long and two short dashed lines in FIG. 2, and the direction indicated by the arrow outlined with the solid line in FIG. 4A) from the ending position to the starting position.

If the second wiping step ends, as a third movement step, the control portion 15 controls the carriage motor 14, and moves the liquid ejecting portion 20 together with the carriage 13 in the waiting position HP or in the transportation area PA. That is, the wiping operation is performed after the printing operation, and the liquid ejecting portion 20 moves in the waiting position HP in the third movement step. If the wiping operation is performed during the printing process and before the performance of the printing operation, the liquid ejecting portion 20 moves to the transportation area PA in the third movement step.

In addition, also in the third movement step, the control portion 15 preferably drives the regulating mechanism 49 and the wiping motor 51 to move the wiping portion 42*a* to the retracted position, and to return the wiping portion 42*a* to the wiping position by stopping the driving of the regulating mechanism 49 after the liquid ejecting portion 20 is moved. This is because unnecessary contact between the moving liquid ejecting portion 20 and the moving wiping portion 42*a* is suppressed in this manner, and a portion in which liquid is not adhered can be prepared as the wiping portion 42*a* for the next wiping operation by moving the portion of the wiping member 42 in which liquid is adhered to the winding axis 46 side.

In this manner, changing the position of the wiping portion 42*a* in the wiping member 42 after the second wiping step is referred to as the second winding step. Then, in the embodiment, the third movement step and the second winding step proceed in parallel.

Subsequently, the effect of the liquid ejecting apparatus 11 is described.

Figure 3A:
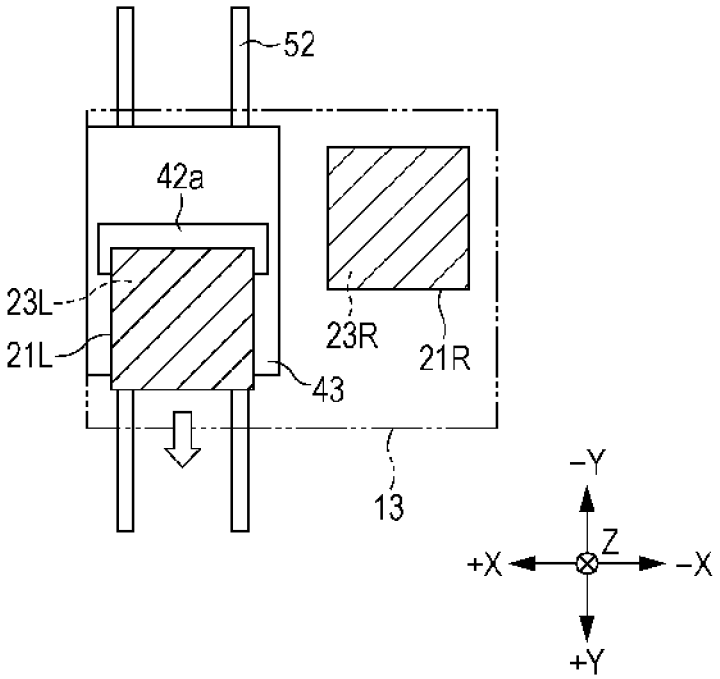
FIGS. 3A and 3B are diagrams schematically illustrating states in which a wiping portion wipes a first wiping target area in a first direction.
Figure 3B:
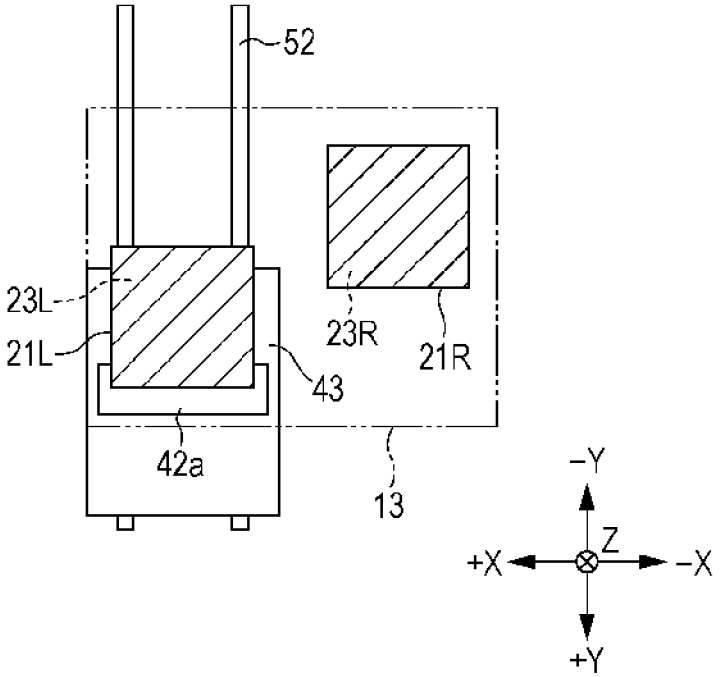

As illustrated in FIGS. 3A and 3B, the wiping portion 42*a* wipes the first wiping target area 23L in the first direction +Y along the outbound movement of the holding mechanism 43.

Figure 4A:
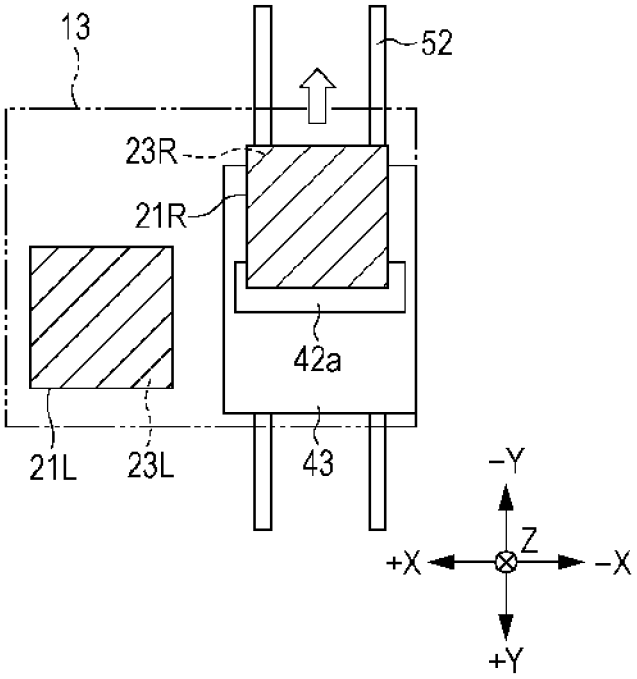
FIGS. 4A and 4B are diagrams schematically illustrating states in which the wiping portion wipes a second wiping target area in a second direction.
Figure 4B:
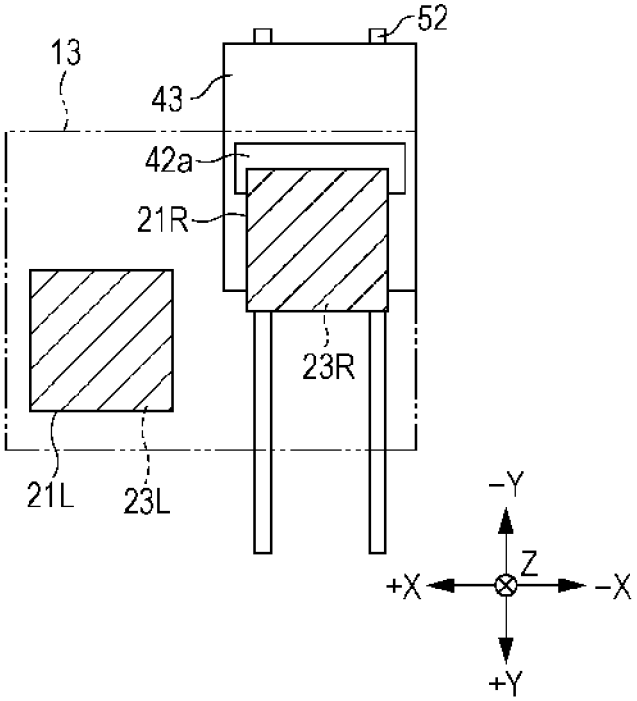

Further, as illustrated in FIGS. 4A and 4B, the wiping portion 42*a* wipes the second wiping target area 23R in the second direction −Y along the inbound movement of the holding mechanism 43. Therefore, the wiping portion 42*a* can wipe the wiping areas 23L and 23R at different positions in the scanning direction X by moving once in the reciprocating manner.

The holding mechanism 43 changes the positions of the wiping portion 42*a* in the wiping member 42 so that the different positions of the wiping member 42 when the wiping portion 42*a* wipes the first wiping target area 23L and when the wiping portion 42*a* wipes the second wiping target area 23R come into contact with the liquid ejecting portion 20. Therefore, even when the second wiping target area 23R is wiped, the adhered matter adhered to the ejecting heads 21 can be removed, and the liquid adhered to the ejecting heads 21 can be absorbed in the same wiping performance of wiping the first wiping target area 23L.

Further, in the first wiping step and the second wiping step, the wiping performance time can be reduced compared to in the case in which the second movement step and the first winding step separately proceed by proceeding the second movement step and the first winding step in parallel.

Since the wiping unit 41 having the wiping portion 42*a* is disposed between the transportation area PA and the waiting position HP for performing the printing operation in the scanning direction X, the wiping unit 41 can perform the wiping operation in the middle of the movement to the waiting position HP after the printing operation ends. Therefore, for example, the time of the first movement step and the third movement step can be reduced compared to in the case of disposing the wiping unit 41 on the outer side (the left side in FIG. 1) of the transportation area PA that becomes the opposite side of the waiting position HP in the scanning direction X.

Further, since the wiping unit 41 is at the position closer to the transportation area PA than the flushing unit 33 and the cap unit 36 that configures the maintenance mechanism 31, the wiping unit 41 can quickly return to the transportation area PA after the wiping operation is performed in the middle of the printing operation and before the printing operation.

In the embodiment, between the first wiping target area 23L and the second wiping target area 23R, the wiping portion 42*a* performs the wiping operation in an order from the first wiping target area 23L that becomes the transportation area PA side in the scanning direction X. Therefore, after the second wiping step, the liquid ejecting portion 20 can quickly move to the transportation area PA without reversing the scanning direction X of the carriage 13.

Further, when the wiping portion 42*a* wipes the first wiping target area 23L later, the liquid ejecting portion 20 is required to go from the first stop position illustrated in FIGS. 3A and 3B to the transportation area PA in the third movement step. In contrast, in the embodiment in which the wiping portion 42*a* wipes the second wiping target area 23R later, the second stop position (position indicated in FIGS. 4A and 4B) closer to the transportation area PA than the first stop position in the third movement step becomes a starting position of the movement to the transportation area PA. That is, since the movement distance of the liquid ejecting portion 20 becomes short in the third movement step, the time for returning to the transportation area PA after the wiping operation is performed is shortened.

In contrast, after the wiping operation is performed, when the liquid ejecting portion 20 returns to the waiting position HP or the like, if the first wiping target area 23L is wiped later, since the first stop position closer to the waiting position HP than the second stop position becomes the starting position of the movement in the third movement step, the time in the third movement step is shortened. Accordingly, between the first wiping target area 23L and the second wiping target area 23R, the wiping portion 42*a* preferably performs the wiping operation in an order from the area on the ending side of the direction in which the liquid ejecting portion 20 moves after two of the wiping areas 23L and 23R are wiped.

In addition, since the starting position and the ending position of the wiping portion 42*a* become the positions in which the wiping portion 42*a* is overlapped with the ejecting heads 21 in the first direction +Y, the times of the first wiping step and the second wiping step are shortened compared to in the case in which the starting position and the ending position of the wiping portion 42*a* are separated from the ejecting heads 21 in the first direction +Y.

Here, if the state of exposing the nozzles 22 in a state in which the liquid ejecting portion 20 does not eject liquid and also the capping operation is not performed continues for a long time, the possibility in which the nozzles 22 are dried, and the ejection error caused by the thickening of the liquid or the like occurs increases. In particular, when the liquid ejecting apparatus 11 includes the drying mechanism for accelerating the drying of the liquid adhered to the medium S or the like, if the nozzles 22 are exposed to the atmosphere, the nozzles 22 are exposed to the wind or the heat generated by the drying mechanism and are easily dried. On that point, it is preferable to reduce the performance time of the wiping operation, since it is possible to prevent the generation of the ejection errors by preventing the drying of the nozzles 22.

In addition, if the circumference of the nozzles 22 is dried, the liquid adhered to the liquid ejecting portion 20 is thickened or adhered, so it is difficult to remove the liquid by wiping. Therefore, for example, after the solidified liquid is redissolved by causing the absorbent impregnated with the solution (cleaning liquid) that redissolves the solidified liquid, such as a solution including the solvent component of the liquid, to come into contact with the wiping areas 23L and 23R, the wiping portion 42*a* may perform the wiping operation.

Further, when the ejecting head 21L is disposed in the upper portion of the wiping unit 41, the liquid receiving portion 32 is caused to be disposed in the lower portion of the ejecting head 21R. Therefore, while the first wiping step is performed, the ejecting head 21R may be caused to perform the flushing operation on the liquid receiving portion 32. In this manner, it is possible to prevent the nozzles 22 of the ejecting head 21R from being dried and clogged while the ejecting head 21L is wiped, and it is possible to prevent the generation of the ejection failure by the flushing.

According to the embodiment, it is possible to achieve advantages described below.

(1) After the wiping portion 42*a* wipes the first wiping target area 23L in the first direction +Y in the outbound movement, the wiping portion 42*a* wipes the second wiping target area 23R in the second direction −Y in the inbound movement. Therefore, the wiping operation can be performed more quickly than in the case in which the wiping portion 42*a* returns to the original position after wiping the first wiping target area 23L in the first direction +Y, and then wipes the second wiping target area 23R in the first direction +Y again.

(2) The size of the wiping unit 41 can be reduced by causing the length of the wiping portion 42*a* in the direction intersecting with the first direction +Y to be shorter than that of the nozzle opening area 23.

(3) Between the first wiping target area 23L and the second wiping target area 23R, after the wiping portion 42*a* wipes the first wiping target area 23L on the transportation area PA side in the scanning direction X intersecting with the first direction +Y, the wiping portion 42*a* wipes the second wiping target area 23R on the waiting position HP side of the liquid ejecting portion 20 moving toward the transportation area PA side. Accordingly, the position of the liquid ejecting portion 20 when the wiping of the two wiping areas 23L and 23R is finished is closer to the transportation area PA than in the case in which the first wiping target area 23L on the transportation area PA side is wiped later. Therefore, the liquid ejecting portion 20 can quickly move to the transportation area PA after the wiping of the wiping areas 23L and 23R is finished.

(4) Since the different positions of the wiping member 42 when the first wiping target area 23L is wiped and when the second wiping target area 23R is wiped come into contact with the liquid ejecting portion 20, the different wiping performances when the two wiping areas 23L and 23R are wiped can be caused to be in the same level.

In addition, the embodiment may be modified as described below.

Figure 5:
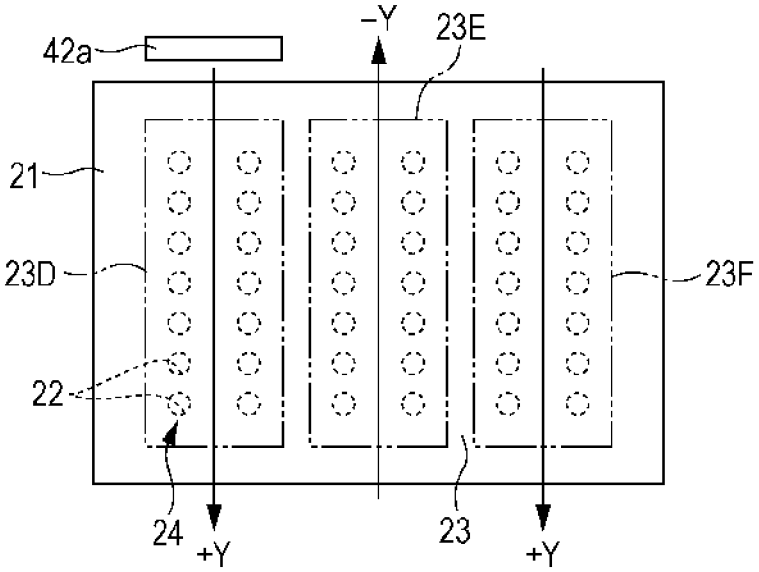
FIG. 5 is a diagram schematically illustrating a liquid ejecting apparatus according to a first modification example.
Figure 6:
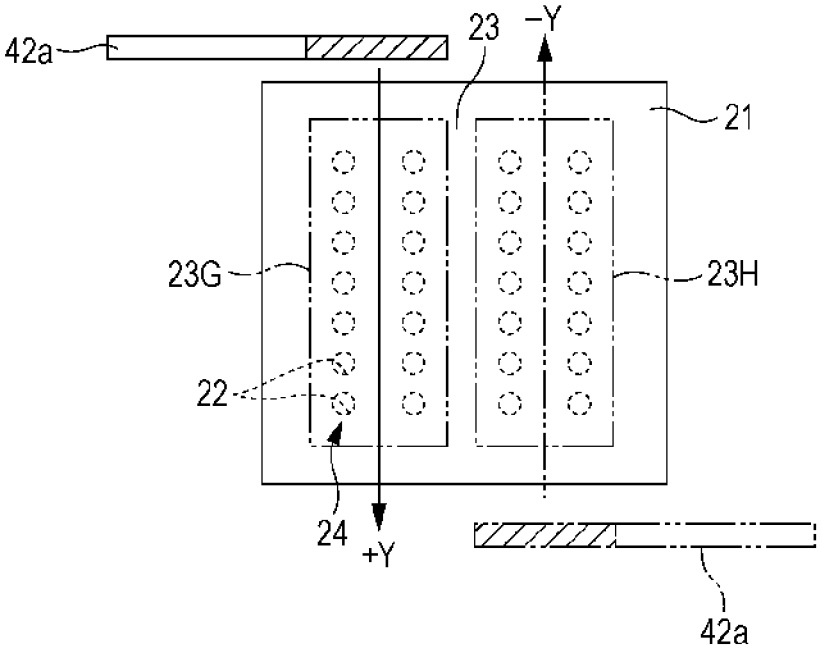
FIG. 6 is a diagram schematically illustrating a liquid ejecting apparatus according to a second modification example.

A plurality of wiping areas may be provided in the nozzle opening area 23 provided in one ejecting head 21, or positions of end portions of the plurality of wiping areas in the first direction +Y and the second direction −Y may be deviated as in a first modification example illustrated in FIG. 5 and a second modification example illustrated in FIG. 6. In addition, the plurality of wiping areas may be separated from each other in the scanning direction X intersecting with the first direction +Y as described in the embodiment above, or may be adjacent to each other in the scanning direction X, or the end portions thereof in the scanning direction X may be overlapped. Further, it may be configured so that the liquid ejecting portion 20 includes three or more ejecting heads 21, and the ejecting heads 21 are each provided with one or more wiping areas.

Then, when three or more wiping areas are provided as in the first modification example in FIG. 5, for example, a first wiping target area 23D is wiped in the first direction +Y in a first outbound movement, a second wiping target area 23E is wiped in the second direction −Y in a first inbound movement, and a third wiping target area 23F is wiped in the first direction +Y in the second outbound movement. That is, if three or more wiping areas are provided, one or more wiping areas wiped by the outbound movement may be referred to as the first wiping target area, and one or more wiping area wiped by the inbound movement may be referred to as the second wiping target area.

According to the configuration, it is possible to perform the wiping operation more quickly than in the case in which the wiping portion 42*a* wipes one wiping area at the time of the outbound movement in the first direction +Y, the wiping portion 42*a* returns to the starting position by the inbound movement, and the next wiping area is wiped at the time of the outbound movement in the first direction +Y again, by shortening the movement distance for the wiping. Further, in this case, without returning the wiping portion 42*a* to the starting position after the third wiping target area 23F is wiped, a first wiping target area may be wiped in the second direction −Y when the next wiping operation is performed. Further, when there are a plurality of wiping areas arranged in parallel in the direction intersecting with the first direction +Y, the sequence of the areas for the wiping operations can be arbitrarily changed.

As in the second modification example illustrated in FIG. 6, the size of the wiping portion 42*a* may be changed to a size in which a plurality of wiping areas 23G and 23H can be wiped by a movement in one direction. Then, after the first wiping target area 23G is wiped in the first direction +Y on one end side (portion indicated by oblique lines in FIG. 6) in a direction intersecting with the first direction +Y of the wiping portion 42*a*, the second wiping target area 23H may be wiped in the second direction −Y on the other end side in the direction intersecting with the first direction +Y of the wiping portion 42*a*. According to the configuration, for example, since the performance of an unnecessary wiping operation on an area in which the nozzles 22 in which there is no ejection failure are open can be prevented by selectively wiping the nozzle rows 24 including the nozzles 22 in which the ejection failure occurs, the abrasion of the liquid ejecting portion 20 according to the wiping operation can be suppressed. In addition, if the configuration is employed, the number of the nozzles 22 (the nozzle rows 24) that are wiped by the movement in one direction can be arbitrarily changed.

The wiping member 42 is not limited to a belt-shaped member that can absorb liquid.

Figure 7A:
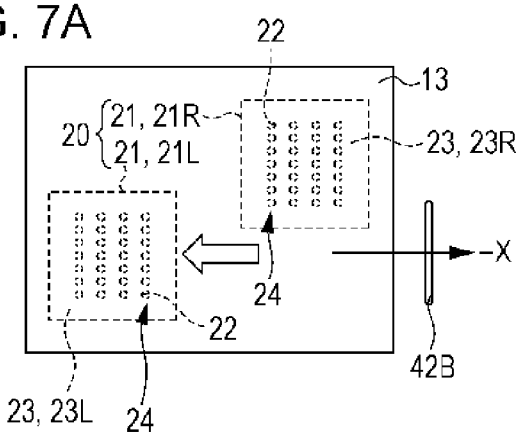
FIGS. 7A to 7C are diagrams schematically illustrating a liquid ejecting apparatus according to a third modification example.
Figure 7B:
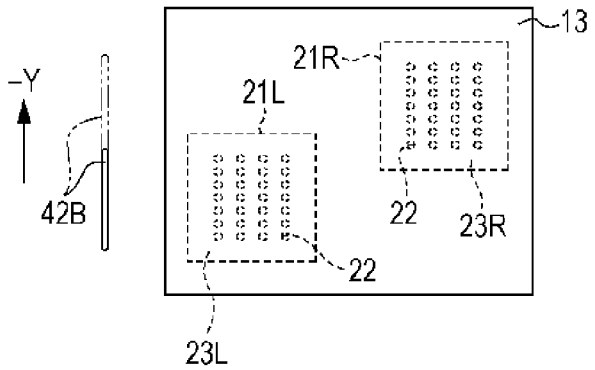
Figure 7C:
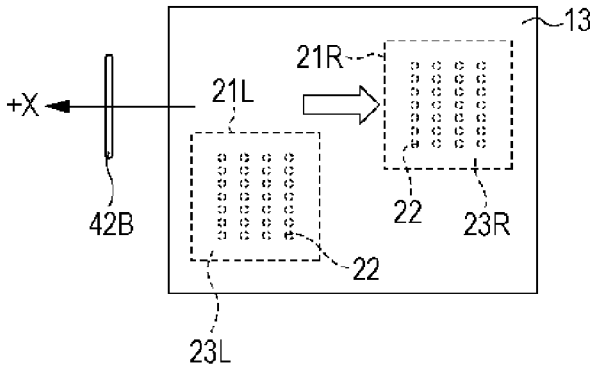

For example, as in the third modification example illustrated in FIGS. 7A to 7C, the blade-shaped wiping member 42B may be formed of an elastomer or the like that does not absorb liquid, and an elastically deformable front end portion of the wiping member 42B may be set to be the wiping portion. However, the wiping member 42 is preferably formed of a member that can absorb liquid, since the liquid is hardly scattered to the surroundings in accordance with the wiping.

Further, as illustrated in FIG. 7A, the liquid ejecting portion 20 may come into contact with the wiping member 42B that does not move while moving in the second scanning direction −X together with the carriage 13, so that the first wiping target area 23L is wiped. At this point, the wiping direction (the leftward direction in FIGS. 7A to 7C and the direction opposite to the moving direction of the liquid ejecting portion 20) indicated by the outline arrow illustrated in FIG. 7A is set to be the wiping direction of the first wiping target area 23L. Further, after the first wiping target area 23L is wiped in the third modification example, the wiping member 42B moves in the second direction −Y as illustrated in FIG. 7B. Thereafter, as illustrated in FIG. 7C, the carriage 13 may come into contact with the wiping member 42B that does not move while moving in the first scanning direction +X so as to wipe the second wiping target area 23R in the wiping direction (the rightward direction in FIGS. 7A to 7C and the direction opposite to the moving direction of the liquid ejecting portion 20) indicated by the outline arrow in FIG. 7C.

That is, a portion that moves in a reciprocating manner for wiping the first wiping target area and the second wiping target area is not limited to the wiping portion, and the first wiping target area and the second wiping target area may be wiped by moving the liquid ejecting portion 20 relative to the wiping portion. According to the configuration, since the configuration of moving the wiping member 42B in the wiping direction may be omitted, it is possible to simplify the configuration of the wiping unit 41.

However, if a nozzle row direction which is a direction in which the plurality of nozzles 22 ejecting the same kind of liquid (for example, ink of the same color) are arranged in parallel intersects with the wiping direction, a different kind of liquid ejected from the nozzles 22 may be mixed into the same nozzles 22 according to the wiping operation. On that point, the nozzle row direction is preferably identical to the wiping direction as in the embodiment above, since the different kind of liquid is prevented from being mixed into the nozzles 22. In addition, if the wiping direction and the nozzle row direction intersect with each other as in the third modification example, the different kind of liquid mixed into the nozzles 22 can be discharged by performing the flushing operation after the wiping operation.

The wiping member 42 is not limited to the belt-shaped member. For example, a rotating body (for example, a roller or a polyhedron) that can absorb liquid is set to be the wiping member, and the position of the wiping portion may be changed by rotating the same rotary body. However, the position of the wiping portion 42*a* is preferably changed while the belt-shaped wiping member 42 is wound, since the size of the wiping unit 41 can be prevented from increasing, and the number of times of changing the new wiping portion 42*a* can increase.

The starting position and the ending position of the wiping portion 42*a* may be positions at which the ejecting head 21R are not overlapped in the moving direction Y. According to the configuration, even if the wiping portion 42*a* is not retracted in the first, second, and third movement steps and at the time when the carriage 13 passes through the wiping unit 41, it is possible to suppress the contact between the liquid ejecting portion 20 and the wiping portion 42*a*. Then, when the configuration is employed, since the regulating mechanism 49 that regulates the rotation of the feeding axis 44 for moving the wiping portion 42*a* to the retracted position may not be included, the configuration of the wiping unit 41 can be simplified.

However, the contact pressure on the ejecting heads 21 of the wiping portion 42*a* can be adjusted by changing the position of the wiping portion 42*a* in the vertical direction Z by the regulating mechanism 49. Therefore, even if it is not required for the wiping portion 42*a* to be retracted, the regulating mechanism 49 may be included for adjusting the contact pressure of the wiping portion 42*a*.

Further, if the starting position and the ending position of the wiping portion 42*a* are not overlapped with the ejecting head 21R in the moving direction Y, there is a concern that the liquid scatters in the wiping direction to be adhered to another wiping area by the force generated when the wiping portion 42*a* is separated from the ejecting heads 21 when the first wiping step and the second wiping step end. Therefore, especially when the positions of the first wiping target area and the second wiping target area are deviated in the wiping direction, the wiping end edge of the first wiping target area wiped in the first wiping direction is preferably disposed on the ending point side in the first wiping direction from the second wiping target area wiped in the second wiping direction.

For example, as illustrated in FIGS. 3A and 3B, the wiping end edge of the first wiping target area 23L is preferably on the ending point side in the first direction +Y from the second wiping target area 23R when the first wiping target area 23L is wiped in the first direction +Y. Accordingly, even if liquid scatters in the first direction +Y by the force generated when the wiping portion 42*a* finishing the wiping of the first wiping target area 23L is separated from the first ejecting head 21L, the scattered liquid is hardly adhered to the second wiping target area 23R.

Further, as illustrated in FIGS. 4A and 4B, when the second wiping target area 23R is wiped in the second direction −Y, the wiping end edge of the second wiping target area 23R is preferably on the ending point side (on the starting point side of the holding mechanism 43 in the moving direction Y according to the embodiment) in the second direction −Y from the first wiping target area 23L. Accordingly, even if liquid scatters in the second direction −Y by the force generated when the wiping portion 42*a* finishing the wiping of the second wiping target area 23R is separated from the second ejecting head 21R, the scattered liquid is hardly adhered to the first wiping target area 23L. Accordingly, it is possible to prevent the droplets from being adhered to the other wiping area according to the wiping operation on one wiping area on one side.

When the second movement step is performed, the first winding step may not be performed. That is, in the first wiping step and the second wiping step, the position of the wiping portion 42*a* in the wiping member 42 may not be changed.

While the first wiping step is performed, or while the second wiping step is performed, the wiping member 42 may be continuously fed out or wound. According to the configuration, since the wiping areas 23L and 23R can be wiped with an unused portion of the wiping member 42 all the time, a higher wiping performance can be obtained. In addition, in this case, the feeding direction and the wiping direction of the wiping member 42 are identical to each other in the first wiping step, and the feeding direction of the wiping member 42 becomes a reverse direction of the wiping direction in the second wiping step. Then, the performance of scratching out the adhered matter is greater in the second wiping step in which the feeding direction of the wiping member 42 becomes the reverse direction of the wiping direction, than in the first wiping step. Therefore, for example, when the nozzles 22 in which the ejection failure occurs exist on one ejecting head 21, the ejecting head 21 may be wiped in the second wiping step.

The maintenance mechanism 31 may have the flushing unit 33 on both sides of the wiping unit 41 in the scanning direction X. According to the configuration, after wiping of the wiping areas 23L and 23R is finished, the flushing operation can be performed on the flushing unit 33 existing on the transportation area PA of the wiping unit 41 in the course of moving the liquid ejecting portion 20 to the transportation area PA.

In this case, the size of the liquid receiving portion 32 existing on the transportation area PA side of the wiping unit 41 is preferably set so that the droplets ejected from all the nozzles 22 of the ejecting head 21L at the same time can be received at once. However, the size of the liquid receiving portion 32 may be set so that the droplets ejected from the nozzles 22 configuring at least one nozzle row 24 can be received in order to shorten the length of the maintenance mechanism 31 in the scanning direction X.

The ending point side (the downstream side of the medium S in the transportation direction) in the first direction +Y is set to be the starting position of the holding mechanism 43, the wiping portion 42*a* may move in the second direction −Y together with the holding mechanism 43 in the outbound way, and also the wiping portion 42*a* may move in the first direction +Y together with the holding mechanism 43 in the inbound way.

The liquid ejecting portion 20 may be wiped by moving the pressing roller 45 in the moving direction Y without moving the feeding axis 44, the winding axis 46, or the wiping member 42 by disposing the feeding axis 44 and the winding axis 46 on the ending point side and the starting point side, respectively, in the first direction +Y.

The liquid ejecting apparatus may be changed into the full line-type liquid ejecting apparatus that does not include the carriage 13, but includes a liquid ejecting portion fixed in a long length shape corresponding to the entire width (the length in the scanning direction X) of the medium S. In this case, in the liquid ejecting portion, the printing scope may extend the entire width of the medium S by disposing a plurality of unit head portions formed by nozzles in parallel, or the printing scope may extend the entire width of the medium S by disposing a plurality of nozzles to extend the entire width of the medium S in a single long head.

The liquid ejecting apparatus may be a printer including a printing function only, or may be a facsimile, a copying apparatus, and a printer included in a multifunctional machine including these apparatuses.

The liquid ejected by the liquid ejecting portion 20 may be fluid (including liquid, a liquid-type matter in which particles of functional materials are dispersed or mixed in the liquid, a fluid-type matter such as gel, and a solid matter that flows as fluid and can be ejected) other than ink. For example, the liquid ejecting portion 20 may eject a liquid-shaped matter including a material such as an electrode material or a coloring material (pixel material) used in the manufacturing of a liquid crystal display, an electroluminescence (EL) display, and a surface light emitting display, in a manner of being dispersed and dissolved.

The entire disclosure of Japanese Patent Application No. 2013-253927, filed Dec. 9, 2013 is expressly incorporated by reference herein.

What is claimed is:

1. A liquid ejecting apparatus comprising:

a liquid ejecting portion provided with a nozzle opening area in which a plurality of nozzles ejecting liquid onto a medium are open; and a wiping portion that wipes the nozzle opening area in a first direction and a second direction opposite to the first direction, wherein the nozzle opening area includes a first wiping target area and a second wiping target area which are at different positions in a direction intersecting with the first direction and are at different positions in the first direction, and wherein the wiping portion wipes the first wiping target area in the first direction, and wipes the second wiping target area in the second direction.

2. The liquid ejecting apparatus according to claim 1, wherein a length of the wiping portion is shorter than that of the nozzle opening area in a direction intersecting with the first direction.

3. The liquid ejecting apparatus according to claim 1, wherein the liquid ejecting portion can move between a transportation area in which the medium is transported and a waiting position at which the liquid ejecting portion waits in a direction intersecting with the first direction, and wherein the wiping portion is disposed between the transportation area and the waiting position in a direction intersecting with the first direction, and wipes the first wiping target area and the second wiping target area in an order from an area on the transportation area side in a direction intersecting with the first direction.

4. The liquid ejecting apparatus according to claim 1, wherein the wiping portion is formed of a portion of a wiping member, and includes a holding mechanism that holds the wiping member, and wherein the holding mechanism changes a position of the wiping portion in the wiping member so that different positions of the wiping member when the wiping portion wipes the first wiping target area and when the wiping portion wipes the second wiping target area come into contact with the liquid ejecting portion.

5. The liquid ejecting apparatus according to claim 1, wherein an end edge of the first wiping target area when the first wiping target area is wiped in the first direction is on an ending point side from the second wiping target area in the first direction.

6. The liquid ejecting apparatus according to claim 1, wherein the liquid ejecting portion can move between a transportation area in which the medium is transported and a waiting position at which the liquid ejecting portion waits in a direction intersecting with the first direction, and wherein the wiping portion is disposed between the transportation area and the waiting position in a direction intersecting with the first direction, and the wiping portion wipes the first wiping target area and the second wiping target area in a direction intersecting with the first direction in an order from an area on an ending point side in a direction of moving the liquid ejecting portion after the wiping.

7. The liquid ejecting apparatus according to claim 1, wherein the wiping portion is formed of a portion of a wiping member, and includes a holding mechanism that holds the wiping member, and the wiping member is detachably attached to the holding mechanism.

8. The liquid ejecting apparatus according to claim 1, wherein the wiping portion is formed of a portion of a wiping member, and includes a holding mechanism that holds the wiping member, and the holding mechanism is disposed on the upstream side of the first direction when the wiping operation is not performed.

9. A liquid ejecting apparatus comprising:

a liquid ejecting portion provided with a nozzle opening area in which a plurality of nozzles ejecting liquid onto a medium are open; and a wiping portion that wipes the nozzle opening area in a first direction and a second direction opposite to the first direction, wherein the nozzle opening area includes a first wiping target area and a second wiping target area which are at different positions in a direction intersecting with the first direction and are at different positions in the first direction, and wherein the wiping portion selectively wipes only a wiping area including nozzles in which ejection failure occurs among the plurality of wiping areas.

10. A liquid ejecting apparatus comprising:

a liquid ejecting portion provided with a nozzle opening area in which a plurality of nozzles ejecting liquid onto a medium are open; and a wiping portion that wipes the nozzle opening area, wherein the nozzle opening area includes a first wiping target area and a second wiping target area which is at different position from the first wiping target area, and wherein the wiping portion wipes the first wiping target area, and wipes the second wiping target area, wherein the wiping portion is formed of a portion of a wiping member, and includes a holding mechanism that holds the wiping member, and wherein the holding mechanism changes a position of the wiping portion in the wiping member so that different positions of the wiping member when the wiping portion wipes the first wiping target area and when the wiping portion wipes the second wiping target area come into contact with the liquid ejecting portion.

11. The liquid ejecting apparatus according to claim 10, wherein the holding mechanism changes the position of the wiping portion between a wiping of the first wiping target area and a wiping of the second wiping target area.

12. The liquid ejecting apparatus according to claim 10, wherein the first wiping target area and the second target area which are at different positions in a direction intersecting with a wiping direction.

* * * * *